US010215464B2

(12) United States Patent
Goel et al.

(10) Patent No.: US 10,215,464 B2
(45) Date of Patent: Feb. 26, 2019

(54) HEAT PUMP SYSTEM HAVING A MAXIMUM PERCENT DEMAND RE-CALCULATION ALGORITHM CONTROLLER

(71) Applicant: Lennox Industries Inc., Richardson, TX (US)

(72) Inventors: Rakesh Goel, Irving, TX (US); Eric Berg, The Colony, TX (US); Pete Hrejsa, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 35 days.

(21) Appl. No.: 15/673,839

(22) Filed: Aug. 10, 2017

(65) Prior Publication Data

US 2017/0336117 A1 Nov. 23, 2017

Related U.S. Application Data

(63) Continuation of application No. 14/198,046, filed on Mar. 5, 2014, now Pat. No. 9,759,466.

(51) Int. Cl.

| | |
|---|---|
| ***F24F 11/00*** | (2018.01) |
| ***F25B 49/02*** | (2006.01) |
| ***F24F 11/30*** | (2018.01) |
| ***F24F 11/62*** | (2018.01) |
| *F24F 140/50* | (2018.01) |

(Continued)

(52) U.S. Cl.

CPC ..... *F25B 49/02* (2013.01); *F24F 11/30* (2018.01); *F24F 11/62* (2018.01); *F24F 2110/10* (2018.01); *F24F 2140/12* (2018.01); *F24F 2140/50* (2018.01); *F25B 13/00* (2013.01); *F25B 49/005* (2013.01); *F25B 2313/029* (2013.01); *F25B 2500/02* (2013.01); *F25B 2700/195* (2013.01); *F25B 2700/1931* (2013.01)

(58) Field of Classification Search

CPC ..... F24F 11/30; F24F 11/62; F24F 2110/10; F24F 2110/12; F24F 2140/12; F24F 2140/50; F25B 13/00; F25B 49/02; F25B 49/005; F25B 2313/029; F25B 2500/02; F25B 2700/195; F25B 2700/1931

See application file for complete search history.

(56) References Cited

U.S. PATENT DOCUMENTS

| | | | |
|---|---|---|---|
| 4,152,902 | A | 5/1979 | Lush |
| 4,278,872 | A | 7/1981 | Koether et al. |

(Continued)

FOREIGN PATENT DOCUMENTS

| | | | |
|---|---|---|---|
| EP | 2876383 | A1 | 5/2015 |
| JP | 2010091209 | A | 4/2010 |

*Primary Examiner* — Jonathan Bradford

(74) *Attorney, Agent, or Firm* — Winstead PC

(57) ABSTRACT

One aspect presents a controller that comprises a control board, a microprocessor located on and electrically coupled to the control board, and a memory coupled to the microprocessor and located on and electrically coupled to the control board. The controller is configured to receive an operating parameter signal and recalculate a first maximum heating % demand to a second maximum heating % demand that is greater than the first maximum heating % demand, when a value of the operating parameter signal exceeds a predetermined value, and operate the HP system based on the second maximum heating % demand.

18 Claims, 4 Drawing Sheets

(51) Int. Cl.

| | |
|---|---|
| *F24F 110/10* | (2018.01) |
| *F24F 140/12* | (2018.01) |
| *F25B 13/00* | (2006.01) |
| *F25B 49/00* | (2006.01) |

(56) References Cited

U.S. PATENT DOCUMENTS

| | | | | | |
|---|---|---|---|---|---|
| 4,334,576 | A | | 6/1982 | Fuchek | |
| 4,364,237 | A | * | 12/1982 | Cooper | F25B 13/00 62/160 |
| 5,314,004 | A | | 5/1994 | Strand et al. | |
| 5,415,346 | A | | 5/1995 | Bishop | |
| 5,492,273 | A | | 2/1996 | Shah | |
| 5,555,927 | A | | 9/1996 | Shah | |
| 5,628,201 | A | * | 5/1997 | Bahel | F24F 11/70 62/211 |
| 5,822,997 | A | | 10/1998 | Atterbury | |
| 6,092,378 | A | | 7/2000 | Das et al. | |
| 6,169,937 | B1 | | 1/2001 | Peterson | |
| 2001/0018831 | A1 | * | 9/2001 | Honda | B60H 1/3225 62/228.1 |
| 2005/0244277 | A1 | | 11/2005 | Hurst et al. | |
| 2006/0207273 | A1 | | 9/2006 | Lee et al. | |
| 2010/0106925 | A1 | | 4/2010 | Grohman et al. | |

* cited by examiner

HEAT PUMP SYSTEM HAVING A MAXIMUM PERCENT DEMAND RE-CALCULATION ALGORITHM CONTROLLER

CROSS-REFERENCE TO RELATED APPLICATIONS

This patent application is a continuation application of U.S. patent application Ser. No. 14/198,046, filed on Mar. 5, 2014. U.S. patent application Ser. No. 14/198,046 is incorporated herein by reference.

TECHNICAL FIELD

This application is directed to heating, ventilation, and air conditioning heat pump systems.

BACKGROUND

Heat pump (HP) systems have gained wide commercial use since their first introduction into the heating, ventilation and air conditioning (HVAC) market because of their operational efficiency and energy savings, and it is this efficiency and energy savings that appeals to consumers and is most often the deciding factor that causes them to choose HPs over conventional HVAC furnace systems. During the winter, a HP system transfers heat from the outdoor air heat exchanger to an indoor heat exchanger where the heat is used to heat the interior of the residence or building. The consumer uses a thermostat to select a temperature set-point for the interior, and the HP system then operates, using heat transferred from the outside, to warm the indoor air to achieve the set-point. As a result, the consumer enjoys a heating capability, while saving energy. Though auxiliary heating systems, such as electric or gas furnaces can be used in conjunction with the HP system, this is typically done only for a brief period of time in order to achieve the set-point in extremely cold conditions.

SUMMARY

One embodiment of the present disclosure presents a HP system that comprises an indoor blower/heat exchanger (ID) system and an outdoor fan/heat exchanger and compressor (OD) system. The ID system and the OD system are fluidly coupled together by refrigerant tubing that forms a refrigerant system. The system also comprises an operating parameter sensor associated with the ID system or OD system to provide an operating parameter signal of the ID system or OD system. A controller is coupled to the HP system and is configured to operate the HP system based on a first maximum heating % demand. The controller is further configured to receive the operating parameter signal and set the first maximum heating % demand to a second maximum heating % demand that is greater than the first maximum heating % demand, when a value of the operating parameter signal exceeds a predetermined value, and operate the HP system based on the second maximum heating % demand.

Another embodiment of the present disclosure is a controller. This embodiment comprises a control board, a microprocessor located on and electrically coupled to the control board, and a memory coupled to the microprocessor and located on and electrically coupled to the control board. The controller comprises a memory coupled to the microprocessor and is located on and electrically coupled to the control board and has a controller couplable to an operating parameter sensor associated with an indoor (ID) system or an outdoor (OD) system of a HP system and is configured to receive an operating parameter signal and set a first maximum heating % demand to a second maximum heating % demand that is greater than the first maximum heating % demand, when a value of the operating parameter signal exceeds a predetermined value, and operate the HP system based on the second maximum heating % demand.

Another embodiment presents a computer program product, comprising a non-transitory computer usable medium having a computer readable program code embodied therein, the computer readable program code adapted to be executed to implement a method of measuring and managing an indoor airflow rate of a heat pump system. The method comprises receiving an operating parameter signal from an operating parameter of the HP system, and setting a first maximum heating % demand to a second maximum heating % demand that is greater than the first maximum heating % demand, when a value of the operating parameter signal exceeds a predetermined value, and operate the HP pump system based on the second maximum heating % demand.

BRIEF DESCRIPTION

Reference is now made to the following descriptions taken in conjunction with the accompanying drawings, in which.

DETAILED DESCRIPTION

Figure 1:
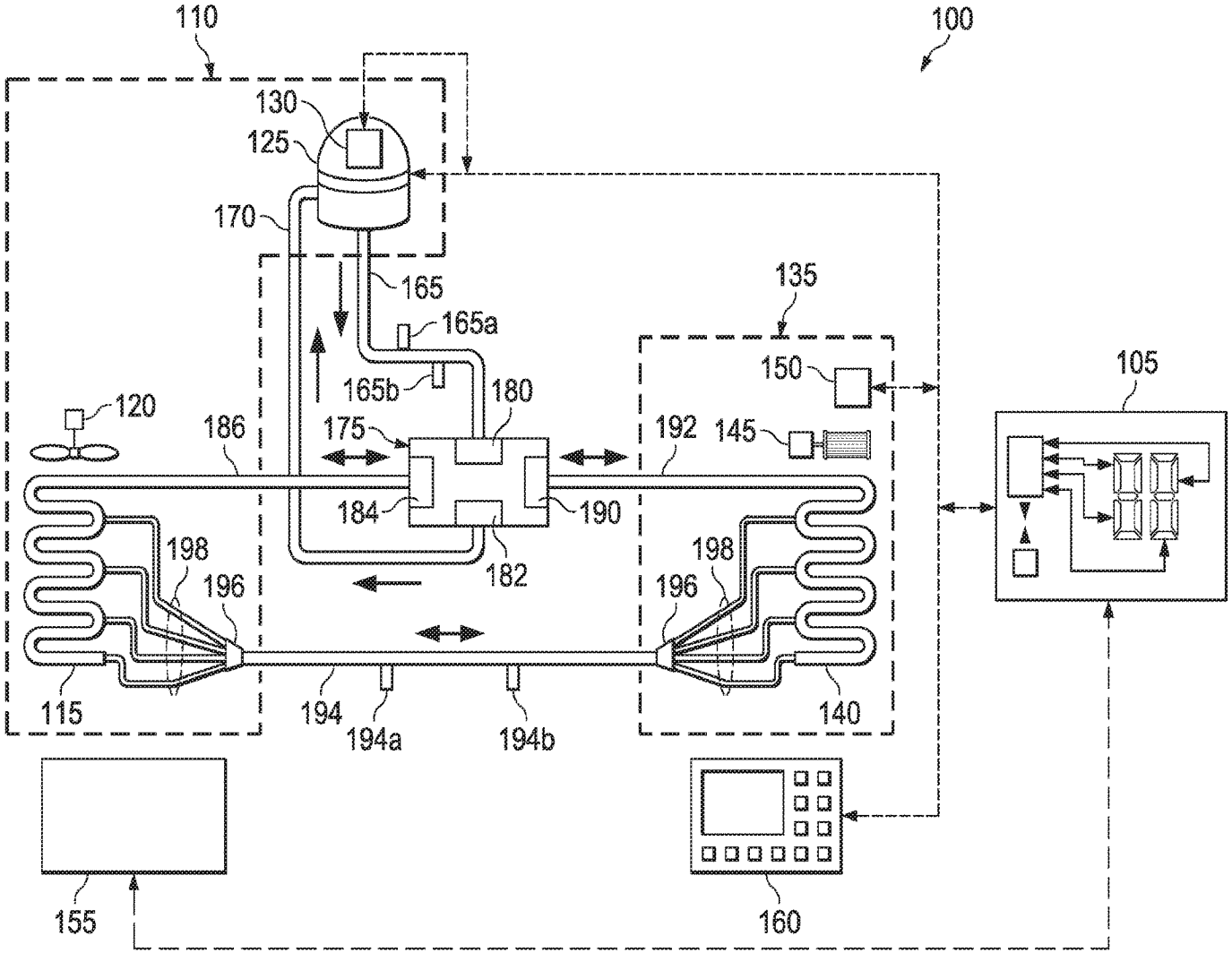
FIG. 1 illustrates a block diagram of an example HP system in which the controller of this disclosure may be implemented.

As noted above, HP systems have gained wide use and are popular with consumers because they can reduce energy costs by using the heat in outdoor air to heat the space of an indoor structure, such as a residence or business. Though these HP systems are typically very efficient in operation and energy savings, there are drawbacks. One such drawback is that, in certain operational modes where the HP system is attempting to reach an indoor temperature set point, as demanded by the HP system's thermostat, the heating % demand of the HP system may be increased. Depending on the existing outdoor ambient temperature conditions, a higher heating % demand can result, for example, in a higher compressor discharge pressure. If the discharge pressure causes the pressure within the refrigeration line to exceed a predetermined maximum pressure, a refrigerant high pressure trip sensor is activated and sends a signal to cause the HP system to shut down or substantially reduce heating % demand. Alternatively, other sensors can constantly monitor the discharge air pressure as opposed to the set point and increase an output of the HP system if, after a given period of time, the discharge air temperature does not equal or exceed the set point temperature of the HP system, which can occur in multiple zone or single zone systems.

In conventional HP systems, the HP system attempts to achieve the indoor temperature set point, typically by ramping the heating % demand up by a set percentage, for example, 5% every set period of time, such as every 2 minutes, until the indoor temperature set point is met or until the HP system shuts down due to exceeding a maximum discharge pressure of the compressor. The shutdown, which may be temporary in certain systems, occurs when the HP system's controller receives a signal from a refrigerant high pressure sensor. For example, if the refrigerant high pressure sensor trips, the HP system can drop maximum heating % demand by a set amount, e.g., 25%, or shutdown and wait about 5 minutes and then re-start. Even after re-start, however, the HP system will drive its operations unabated until another trip signal occurs. Such conventionally controlled HP systems can continue to cycle in either of these two ways, resulting in undesirable fluctuating heating or a service call by the user.

A maximum heating % demand is the maximum heating capacity the HP system is designed to reach without potentially harming the system or causing a system shutdown, and it is typically related to a set maximum discharge pressure of the compressor. However, it should be noted that other HP system operating parameters can also be used to govern the maximum heating capacity of the HP system. The heating % demand is the amount of heat the HP system is demanding to reach the desired indoor temperature set point. The signal may be generated by one or more sensors, such as pressure sensors, transducers, or temperature sensors that monitor operations of various components of the HP system, such as compressor discharge pressure, refrigerant line pressure, or outdoor or indoor fan speeds.

To address these operational disadvantages, the embodiments of the current disclosure present a controller that operates the HP system in two different, basic modes, a normal limit mode that operates the HP system pursuant to a first maximum heating % demand, and an extended limit mode that operates the HP system pursuant to a higher, second maximum heating % demand. The controller is coupled to the HP system, and in one embodiment, is configured to initially operate the HP system based on the first maximum heating % demand. The controller, however, is further configured to receive an operating parameter signal from one or more of the HP systems components and set the first maximum heating % demand to the second maximum heating % demand that has a value greater than the first maximum heating % demand, when a value of the operating parameter signal or signals exceed a predetermined value. The controller then operates the HP system based on the second maximum heating % demand.

For example, in one embodiment, the HP system starts in the normal limit mode that operates the HP system based on a first maximum heating % demand. The HP system may be initially configured to run in the normal limit mode and then switch to the extended limit mode when the target set point air temperature is not reached during operation. If during the normal limit mode, the target discharge air temperature is not met, the HP system will continue to attempt to reach the target discharge air temperature by increasing heating % demand up to the first maximum heating % demand. If the target discharge air temperature is still not met when the first maximum heating % demand is reached or exceeded, the controller switches the HP system's operation to the extended limit mode, which operates the HP system based on a second maximum heating % demand. In one embodiment, during a given heating cycle, the controller will operate the HP system such that the second maximum heating % demand is approached more gradually or in smaller increments, so as to prevent the HP system from quickly reaching any trip condition within the HP system. The second maximum heating % demand allows the HP system to avoid shutdowns of the HP system, while attempting to achieve the indoor discharge airflow temperature set point, and thereby, run more consistently to provide a more uniform heating function for the customer.

The extended limit mode allows the maximum heating % demand/% indoor airflow ratio to reach a higher value than when in the normal limit mode. For example in one embodiment, the normal limit mode may be set so that the maximum heating % demand/% indoor airflow ratio is always equal to or less than 2, which may provide a discharge pressure of between 400-500 psig, depending on the HP system. If, however, the target discharge air temperature is not met when the HP system reaches the first maximum heating % demand of the normal limit mode, the second maximum heating % demand of the extended limit mode is used to operate the HP system. For example, the extended limit may be set so that the maximum heating % demand/% indoor airflow ratio is always equal to or less than 4, which may provide a discharge pressure of between 500-600 psig, depending on the HP system.

If during operation in the extended limit mode, a sensor switch is tripped, which generates a signal indicating that the second maximum heating % demand has been reached or exceeded, the second maximum heating % demand is recalculated to a lower, third maximum heating % demand value based on some fraction of the heating % demand at the time the signal was generated. The heating % demand is then raised more gradually, or incremented, toward the third maximum heating % demand operating conditions.

In one embodiment, the trip signal may be generated by a refrigerant line pressure sensor. The controller uses the current heating % demand at the occurrence of the trip signal from which it calculates a third maximum heating % demand, which is a fraction of the current heating % demand. In such instances, the controller may operate the HP system based on the third maximum heating % demand. In one embodiment, when the trip signal occurs, the operational parameters of the various HP system components, such as the indoor or outdoor fan speeds, compressor speed, or refrigerant line pressure are stored in a memory accessible by the controller. Any of these operational parameters, or a combination thereof, may be used as the basis for determining when the HP system is approaching the third maximum heating % demand.

In those instances where a trip does not occur during the extended limit mode, the controller continues to operate the HP system in the extended limit mode as long as the indoor discharge air temperature is greater than or equal to the discharge air temperature set point. However, if the desired discharge air temperature set point is not achieved in a specified amount of time, which depends on the HP system, the controller will begin another incrementing routine that gradually allows the heating % demand to be raised toward the second maximum heating % demand value. In so doing, the controller will operate the HP system by varying one or more of the operational parameters of the above mentioned components to cause the HP system to increment toward the second maximum heating % demand. The increments may be a set percentage that changes over a period of time, or it may be a varying percentage value that changes over a period of time. In another aspect of these embodiments, the incremental changes are not time dependent.

In other embodiments, the controller may further operate the HP system after switching to the extended limit mode in such a manner that when the HP system reaches a predetermined heating % demand value that is less than the second maximum heating % demand, the controller will not increase the operational parameters of the HP system further so as to avoid exceeding the second maximum heating % demand, thereby avoiding further inadvertent shutdowns of the HP system. In one aspect of the embodiment, if the HP system has operated for an extended time at reduced operating conditions based on the second maximum heating % demand, the controller may reset the HP system to the normal limit mode conditions.

Alternatively, the outdoor ambient temperature may have changed sufficiently to allow the HP system to operate under normal conditions, and if so, the controller may reset the HP system to the normal limit mode conditions. Thus, the embodiments of the controller provide greater control over the way in which the recalculated heating % demand is approached by the HP system, and thus, lessens the occurrence of another trip signal.

In one embodiment where the controller increments toward a given heating % demand, the controller may cause the HP system to approach the second extended limit maximum heating % demand or the third maximum heating % demand by 1% every two minutes in which the indoor temperature set point is not met. In another embodiment, the controller may cause the HP system to approach the second or third maximum heating % demands by 3% every two minutes in which the indoor temperature set point is not met, then by 1.5% every 3 minutes, then by 0.75% every 4 minutes, etc., until the HP system either reaches the desired set point, re-sets the HP system, or experiences a second shutdown. In those embodiments, where the controller is configured to allow a second shutdown event, the controller may perform a second recalculation of the second or third maximum heating % demands, depending on which is being used, in a similar manner as described above. It should be noted that the number of above-described recalculations may vary and that the percentages and times given above are for purposes of providing examples only and that these values may vary depending upon the design of the HP system.

One embodiment of the controller, as implemented in a HP system 100, is illustrated in FIG. 1. FIG. 1 illustrates a block diagram of an example of the HP system 100 in which a controller 105, as provided by embodiments described herein, may be used. Various embodiments of the controller 105 are discussed below. The HP system 100 comprises an outdoor (OD) system 110 that includes a heat exchanger 115, equipped with an outdoor fan 120, which in certain embodiments may be a conventional variable speed fan, a compressor 125, and an optional outdoor controller 130, coupled to the OD system 110. When present, the outdoor controller 130 may be coupled to the OD system 110 either wirelessly or by wire. For example, the outdoor controller 130 may be coupled to either the compressor 125 or the fan 120, or both. In the illustrated embodiment, the outdoor controller 130 is attached directly to the compressor 125 and is coupled to the compressor 125 by wire. If the outdoor controller 130 is not present, it may be controlled by the controller 105.

The HP system 100 further includes an indoor (ID) system 135 that comprises an indoor heat exchanger 140, equipped with an indoor blower 145, such as a conventional, variable speed blower. The ID system 135 may further include an indoor system controller 150. The indoor system controller 150 may be coupled to the ID system 135 either wirelessly or by wire. For example, the indoor system controller 150 may be located on a housing (not shown) in which the blower 145 is contained and hard wired to the blower 145. Alternatively, the indoor system controller 150 may be remotely located from the blower 145 and be wirelessly connected to the blower 145. The indoor system controller 150 may also be optional to the system, and when it is not present, the indoor system 135 may be controlled by the controller 105.

The HP system 100 further includes an outdoor temperature data source 155 that is coupled to the controller 105. In one embodiment, the outdoor temperature data source 155 may be a temperature sensor located adjacent or within the OD system 110 and coupled to controller 105 either wirelessly or by wire. For example, the temperature sensor may be located on the same board as the outdoor controller 130. In an alternative embodiment, the temperature data source 155 may be an internet data source that is designed to provide outdoor temperatures. In such instances, the controller 105 would include a communication circuit that would allow it to connect to the internet through either an Ethernet cable or wirelessly through, for example a Wi-Fi network.

The HP system 100 further includes a thermostat 160, which, in certain embodiments may be the primary controller of the HP system 100, that is, the controller 105 may be located within thermostat 160. The thermostat 160 is preferably an intelligent thermostat that includes a microprocessor and memory with wireless communication capability and is of the type described in U.S. Patent Publication, No. 2010/0106925, Application, Ser. No. 12/603,512, which is incorporated herein by reference. The thermostat 160 is coupled to the outdoor controller 130 and the indoor controller 150 to form, in one embodiment, a fully communicating HP system, such that all of the controllers or sensors 105, 130, 150, 155, and 160 of the HP system 100 are able to communicate with each other, either by being connected by wire or wirelessly. In one embodiment, the thermostat 160 includes the controller 105 and further includes a program menu that allows a user to activate the HP system 100 by selecting the appropriate button or screen image displayed on the thermostat 160. In other embodiments, the controller 105 may be on the same board as the outdoor controller 130 or the indoor controller 150. Thus, the controller 105 may be located in various locations within the HP system 100.

In general, the compressor 125 is configured to compress a refrigerant, to transfer the refrigerant to a discharge line 165, and, to receive the refrigerant from a suction line 170. The discharge line 165 fluidly connects the compressor 125 to the outdoor heat exchanger 115, and the suction line 170 fluidly connects the indoor heat exchanger 140 to the compressor 125 through a reversing valve 175. The reversing valve 175 has an input port 180 coupled to the discharge line 165, an output port 182 coupled to the suction line 170, a first reversing port 184 coupled to a transfer line 186 connected to the outdoor heat exchanger 115, and a second reversing port 190 coupled to a second transfer line 192 connected the indoor heat exchanger 140. As understood by those skilled in the art, the transfer lines 186, 192 allow for the reversal of the flow direction of the refrigerant by actuating the revering valve 175 to put the HP system 100 in a cooling mode or a heating mode. One skilled in the art would also appreciate that the HP system 100 could further include additional components, such as a connection line 194, distributors 196 and delivery tubes 198 or other components as needed to facilitate the functioning of the system.

In addition, the HP system 100 includes one or more conventional refrigerant high pressure sensors 194*a*, 194*b* located on the connection line 194, or sensors 165*a*, 165*b* located on the discharge line 165, or some combination of the two. The refrigerant high pressure sensors, as noted above, are configured to generate a trip signal when the pressure within the connection line 194 or discharge line 165 exceeds a set high pressure limit of the HP system 100. When two refrigerant high pressure sensors are present, a first sensor has a lower pressure setting than the second sensor and may be located adjacent the secondary refrigerant high pressure sensor. In the embodiments where two refrigerant high pressure sensors are present, the first refrigerant high pressure sensor may be configured to govern the HP system 100 when operating in the above-discussed limit modes and the second refrigerant high pressure sensor can act as a fail-safe or safety net pressure sensor for the HP system.

Figure 2:
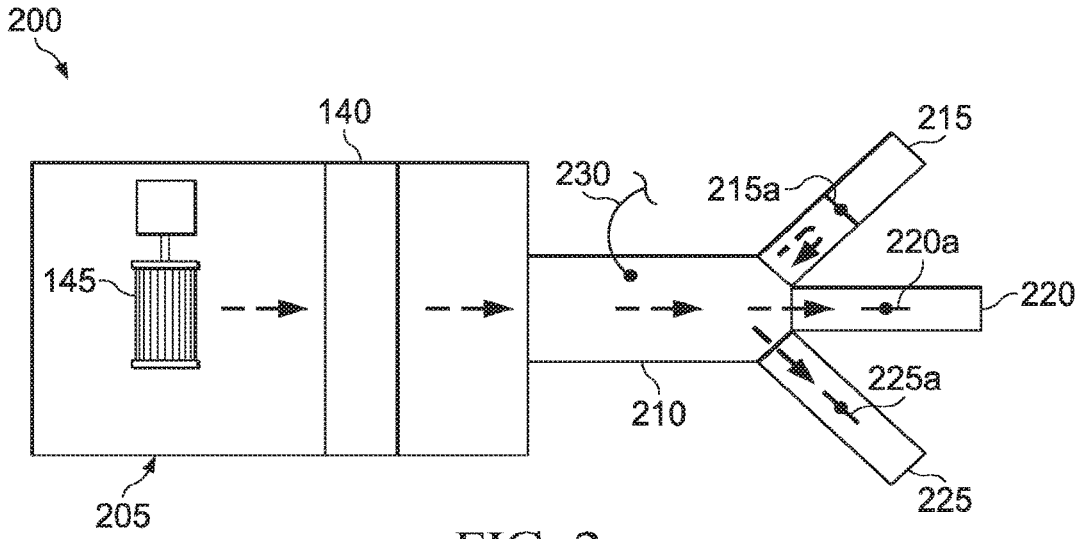
FIG. 2 shows a schematic diagram of a multi-zoned plenum system that may form a portion of the HP system of FIG. 1.

FIG. 2 illustrates a schematic view of a conventional multi-zone plenum 200, which may be present in certain HP system 100 configurations. In the illustrated embodiment, the plenum comprises a distribution plenum 205, in which is located the indoor blower 145 and the indoor heat exchanger 140 of the HP system 100 of FIG. 1. The distribution plenum 205 has a primary feed duct 210 coupled to it through which indoor air passes from the distribution plenum 205 to zoned ducts 215, 220 and 225, and in which a conventional thermocouple 230 is located to measure the temperature of the airflow from the distribution plenum 205. The zoned ducts may be of conventional design and include conventionally controlled air dampers 215*a*, 220*a*, and 225*a*, respectively. The air dampers 215*a*, 220*a*, and 225*a* may be controlled by the controller 105, thermostat 160, or another controller associated with the HP system 100. The present invention is applicable in multi-zoned systems, because often times, the airflow demand, in one zone may be lower than the airflow demand in another zone. In such instances, the damper to the zone having a different airflow demand may be closed, while the dampers to the other zones remain open, as illustrated in FIG. 2. When such conditions exist, the overall indoor airflow rate is reduced, which can make it more difficult to reach temperature set points. As a result, the compressor discharge pressure can increase enough to cause a HP system sensor to trip and either reduce the operation of or shut down the HP system 100.

Figure 3:
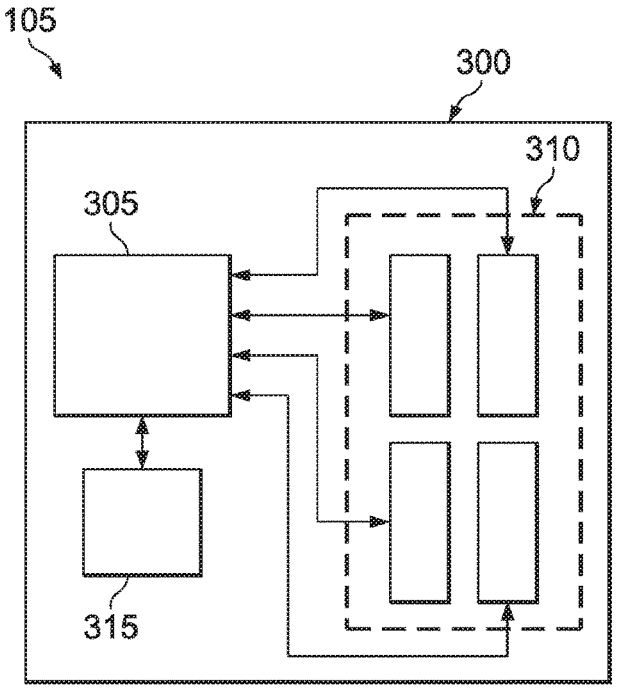
FIG. 3 shows a schematic of a layout diagram of an embodiment of the enhanced controller circuit board.

FIG. 3 illustrates a schematic view of one embodiment of the controller 105. In this particular embodiment, the controller 105 includes a circuit wiring board 300 on which is located a microprocessor 305 that is electrically coupled to memory 310 and communication circuitry 315. The memory 310 may be a separate memory block on the circuit wiring board 300, as illustrated, or it may be contained within the microprocessor 305. The communication circuitry 315 is configured to allow the controller 105 to electronically communicate with other components of the HP system 100, either by a wireless connection or by a wired connection. The controller 105 may be a standalone component, or it may be included within one of the other controllers previously discussed above or with another component controller of the HP system. In one particular embodiment, the controller 105 will be included within the thermostat 160. In those embodiments where the controller 105 is a standalone unit, it will have the appropriate housing and user interface components associated with it.

In another embodiment, the controller 105 may be embodied as a series of operational instructions that direct the operation of the microprocessor 305 when initiated thereby. In one embodiment, the controller 105 is implemented in at least a portion of a memory 310 of the controller 105, such as a non-transitory computer readable medium of the controller 105. In such embodiments, the medium is a computer readable program code that is adapted to be executed to implement a method of operating the HP system 100 either under the normal limit mode or the extended limit mode. The method comprises initially operating the HP system 100 in the normal limit mode and based on the first maximum heating % demand, until a signal is sent that indicates operating conditions are such that require the HP system 100 to be operated in the extended limit mode and based on the second maximum heating % demand. The controller 105 then operates the HP system 100 based on the second maximum heating % demand.

In one embodiment, the controller 105 is coupled to the HP system 100 and configured to operate the HP system 100 based on the first maximum heating % demand when in the normal limit mode. In such instances, the first maximum heating % demand may be determined as follows: first maximum heating % demand/% indoor airflow rate=A+{B×((ODT_ref+C)/(ODT+D))^N}, wherein the first maximum heating % demand is an initial maximum limit heating % demand of the HP system, ODT_ref is a reference outdoor temperature in degrees Fahrenheit adjusted for a given HP system, and ODT is the outdoor temperature in degrees Fahrenheit. The % indoor airflow rate=indoor airflow rate/indoor airflow rate @100% heating demand, where indoor airflow rate is airflow output of the ID system, and where A, B, C, D, and N are real numbers adjusted to match a first maximum heating % demand of a given HP system.

When a predetermined value of an operating parameter of one or more of the components of the HP system 100 is received by the controller 105, indicating that the current heating % demand has become equal to or has exceeded the first maximum heating % demand, the controller 105 is further configured to recalculate or set the first maximum heating % demand to the second maximum heating % demand and operate the HP system 100 based on the second maximum heating % demand. As used herein and in the claims "recalculate" includes those instances where the controller's algorithm calculates the second maximum heating % demand value, as well as those instances where a pre-set value is programmed into the controller 105 and the controller 105 merely applies or sets the second maximum heating % demand to the pre-set value. It should be understood that the values determined by or set in the controller 105 will vary from one HP system 100 to another.

Once the signal is received indicating that the extended limit mode should be used, the controller 105 then operates the HP system 100 in that mode. In one embodiment, the controller 105 calculates the second maximum heating % demand of the extended limit mode as follows: second maximum heating % demand/% indoor airflow rate=A+{B×((ODT_ref+C)/(ODT+D))^N}, wherein the second maximum heating % demand is the maximum heating % demand after recalculation of the first maximum heating % demand of the HP system, ODT_ref is a reference outdoor temperature in degrees Fahrenheit adjusted for a given HP system, and ODT is the outdoor temperature in degrees Fahrenheit. The % indoor airflow rate=indoor airflow rate/indoor airflow rate @100% heating demand, where indoor airflow rate is airflow output of the HP's ID system, and where A, B, C, D, and N are real numbers selected such that the second maximum heating % demand value is greater than said first maximum heating % demand and adjusted to match a second maximum heating % demand of the given HP system.

In another embodiment, the controller 105 is further configured to test operating parameters of the HP system 100 at a set time interval and reset the operating parameters of the HP system 100 to operational settings based on the first maximum heating % demand, for reasons discussed above. In alternative embodiments, the controller 105 may be configured to reset the HP system 100 to the normal limit mode when an outdoor temperature reaches a predetermined value.

In certain applications where the controller 105 is operating the HP system 100 in the extended limit mode, a signal, such as a high pressure trip signal may be received by the controller indicating that the second maximum heating % demand has been met or exceeded prior to the HP system reaching the indoor set point temperature. In such instances, the controller 105 may be further configured to recalculate the second maximum heating % demand to the third maximum heating % demand. In one aspect of this embodiment, the controller 105 recalculates the third maximum heating % demand, as follows: Third maximum heating % demand=B× current heating % demand at trip signal, wherein B is a real number having a value between zero and 1.

Once either the second maximum heating % demand or the third maximum heating % demand is set, the controller 105 can also be configured to increment the HP system's 100 operation in a manner that approaches either of these two heating % demand values in an incremental fashion, as described herein, which avoids a sudden trip condition.

Figure 4:
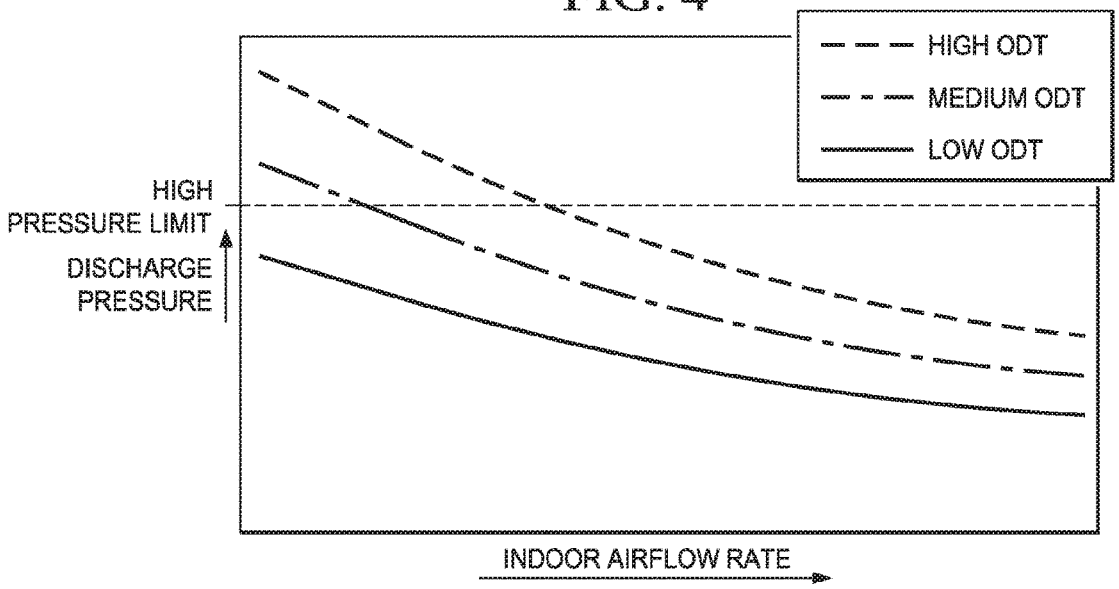
FIG. 4 is a graph showing the relationship between discharge pressure and indoor airflow rate at various outdoor ambient temperatures (ODT), where at low airflow rates, discharge pressure exceeds system high pressure limit.

FIG. 4 is a graph that relates the indoor airflow rate with the discharge high pressure and outdoor ambient temperature. As seen in FIG. 4, as the indoor airflow rate decreases, the discharge pressure increases. Thus, in one embodiment, as certain zones within a HP system are closed off, the indoor airflow rate is decreased, relative to the outdoor ambient temperature, which can cause the discharge pressure of the HP system to increase and generate a trip signal. When the appropriate signal is received, the controller 105 operate the HP system 100 in a manner, as discussed above, which allows the HP system 100 to continue to function and achieve the indoor temperature set point within the air conditioned space. The controller 105 may be activated by the user or a technician at the time of installation.

An advantage of the embodiments of the controller 105, as presented herein, is that the avoidance of excessive trip shutdowns can be achieved by less expensive controller software. The present controller not only simplifies design, but also reduces the costs associated with conventional controllers.

Figure 5:
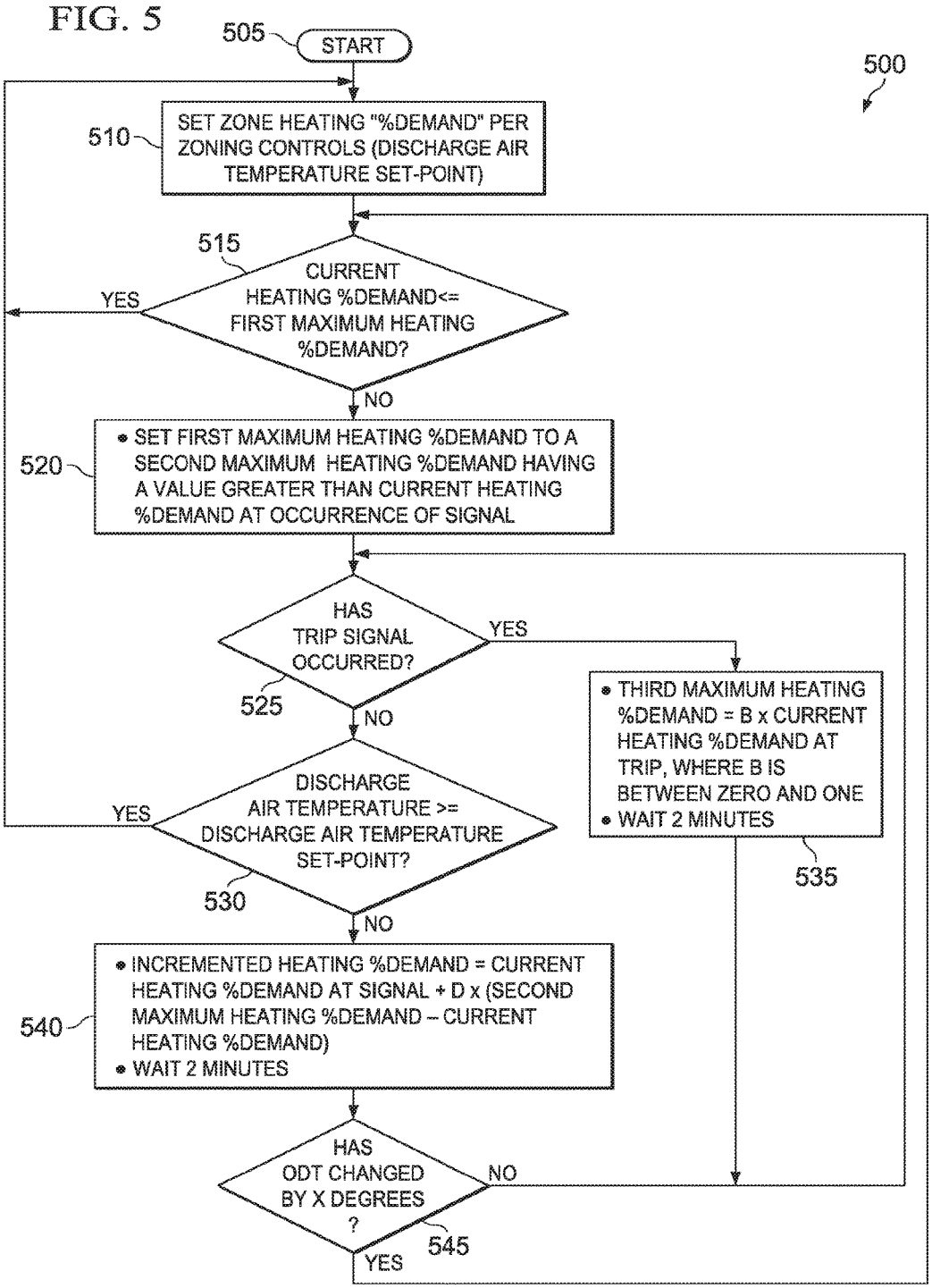
FIG. 5 presents a flow diagram of an example operation of a HP system having an embodiment of the controller, as provided herein, associated therewith.

FIG. 5 illustrates a generalized logic flow chart 500 of the operation of a HP system implementing one embodiment of the controller 105, as provided herein. The method 500 starts at step 505. The controller may be initiated upon installation or it may be initiated by the user via a main control panel, such as by way of a thermostat. The program then proceeds to step 510 in which the heating % demand per zone, if available in the system, is set and the discharge air temperature set point for each zone is also set at this time. These values may have been entered at an earlier time by the installation technician or by the user. At this stage, the controller is programmed to operate the HP system in the normal limit mode based on a first maximum heating % demand, as discussed above.

While in the normal limit mode, the controller logic proceeds to a step 515 wherein the controller 105 detects whether any signals have been received from one or more component sensors that would indicate that the current heating % demand is less than or equal to the first maximum heating % demand. If "yes" then the control logic returns to step 510 and repeats. If "no" then the logic flow proceeds to step 520. For a "no" response to appear, the controller 105 has received a signal from one or more of the HP system components indicating that an operating parameter of one of more of those components has exceeded a predetermined value (for that given HP system), thereby indicating that the current heating % demand has exceeded the first maximum heating % demand in the HP system's attempts to meet the indoor temperature set point. This signal may be generated by one or more sensors, as noted above.

When the controller determines that the current heating % demand has exceeded the first maximum heating % demand, the controller in step 520 sets the HP system to the extended limit mode of operation and causes the HP system to operate based on a second maximum heating % demand that has a value greater than the first maximum heating % demand or the current heating % demand existing at the occurrence of the signal. This allows the HP system to continue its operation without interruption, by allowing the HP system to reach a higher value of maximum heating % demand. In a step 525, the controller determines if a trip signal has occurred that would indicate that the second maximum heating % demand has been met or exceeded. If "no," the logic flow proceeds to step 530, where the controller determines whether the discharge air temperature is greater than or equal to the discharge air temperature set point. If "yes," the controller recalculates the second maximum heating % demand to a third maximum heating % demand in a step 535, which is set equal to some fraction "B," which may be any number less than one and greater than zero. (e.g. 0.75, in one embodiment), of the current heating % demand at the time of the trip signal. The HP system may then be instructed to wait 2 minutes and then return to step 525. When step 535 routine is implemented, the controller may be configured to incrementally increase the heating % demand towards the third maximum heating % demand but will, ideally, not allow it to be exceeded. This portion of the algorithm may also be repeated with each incremented heating % demand value getting closer to the third maximum heating % demand, until the indoor temperature set point is met, or the value reaches a predetermined value less than the third maximum heating % demand, at which point, in one embodiment, the controller may reset the operating conditions of the HP system, after a predetermined period of time.

If in step 530, the discharge air temperature is not greater than or equal to the discharge air temperature set point, the logic flow proceeds to a step 540 in which the heating % demand is incremented toward the second maximum heating % demand in a manner, as discussed above. When step 540 has been initiated, the logic flow proceeds to step 545 to determine if the outdoor temperature has changed by a set number of degrees such that the extended limit mode is no longer necessary. If "yes", the logic flow resets the HP system back to step 510. If "no", the logic flow returns to step 525. Alternatively, step 545 may query whether a certain amount of time has passed in a given heating cycle, and if so, the controller may also reset the HP system back to the normal limit mode in step 510.

Those skilled in the art to which this application relates will appreciate that other and further additions, deletions, substitutions and modifications may be made to the described embodiments.

What is claimed is:

1. A method of operating a heat pump (HP) system, the method comprising:

operating, by a controller, the HP system based on a first maximum heating % demand;

determining, by the controller, whether an operating parameter signal indicates that a current heating % demand exceeds the first maximum heating % demand;

responsive to a determination that the operating parameter signal indicates that the current heating % demand exceeds the first maximum heating % demand, setting the first maximum heating % demand to a second maximum heating % demand and operating the HP system based on the second maximum heating % demand;

wherein the controller sets the first maximum heating % demand as follows:

first maximum heating % demand/% indoor airflow rate=$A+\{B\times((\text{ODT_ref}+C)/(\text{ODT}+D))\hat{}N\}$, wherein:

first maximum heating % demand is an initial maximum limit heating % demand of the HP system, ODT ref is a reference outdoor temperature in degrees Fahrenheit adjusted for a given HP system, ODT is the outdoor temperature in degrees Fahrenheit, % indoor airflow rate=indoor airflow rate/indoor airflow rate @100% heating demand, where indoor airflow rate is airflow output of an indoor system, and where A, B, C, D, and N are real numbers; and wherein the controller sets the second maximum heating % demand as follows:

second maximum heating % demand/% indoor airflow rate=$A+\{B\times((\text{ODT_ref}+C)/(\text{ODT}+D))\hat{}N\}$, wherein:

second maximum heating % demand is the maximum heating % demand after recalculation of the first maximum heating % demand of the HP system, ODT_ref is a reference outdoor temperature in degrees Fahrenheit adjusted for a given HP system, ODT is the outdoor temperature in degrees Fahrenheit, % indoor airflow rate=indoor airflow rate/indoor airflow rate @100% heating demand, where indoor airflow rate is airflow output of the indoor system, and where A, B, C, D, and N are real numbers.

2. The method of claim 1, wherein the second maximum heating % demand value is greater than the first maximum heating % demand.

3. The method of claim 1, wherein the controller comprises:

a control board;

a microprocessor located on and electrically coupled to the control board; and a memory coupled to the microprocessor and located on and electrically coupled to the control board and having a controller couplable to an operating parameter sensor associated with the indoor system or an outdoor system of the HP system.

4. The method of claim 3, further comprising:

incrementing, by the controller, a heating % demand towards the second maximum heating % demand when a discharge air temperature of the indoor system is equal to or less than a discharge air temperature set point of the indoor system.

5. The method of claim 1, further comprising:

testing, by the controller, operating parameters of the HP system at a set time interval and resetting operating parameters to operational settings of the HP system based on the first maximum heating % demand.

6. The method of claim 1, further comprising:

resetting the HP system to operational settings based on the first maximum heating % demand when an outdoor temperature reaches a predetermined value.

7. The method of claim 1, wherein the HP system, when operating based on the second maximum heating % demand, is configured to receive a refrigerant high pressure trip signal from a refrigerant high pressure trip sensor and recalculate the second maximum heating % demand to a third maximum heating % demand based on a current heating % demand existing when the controller receives the refrigerant high pressure trip signal and operate the HP system based on the third maximum heating % demand.

8. The method of claim 7, further comprising:

recalculating, by the controller, the third maximum heating % demand, wherein the recalculating is performed as follows:

Third maximum heating % demand=$B\times$current heating % demand at trip signal, wherein:

B is a real number having a value between zero and 1.

9. The method of claim 3, wherein the indoor system comprises an indoor heat exchanger equipped with an indoor blower.

10. The method of claim 9, wherein the outdoor system comprises an outdoor heat exchanger equipped with an outdoor fan.

11. The method of claim 10, wherein the indoor system and the outdoor system are fluidly coupled by a refrigerant tubing that forms a refrigerant system.

12. A heat pump (HP) system comprising:

a controller, wherein, prior to receiving a refrigerant high pressure trip signal from a refrigerant high pressure trip sensor, the controller is configured to:

operate the HP system based on a first maximum heating % demand;

determine whether an operating parameter signal indicates that a current heating % demand exceeds the first maximum heating % demand;

responsive to a determination that the operating parameter signal indicates that the current heating % demand exceeds the first maximum heating % demand, set the first maximum heating % demand to a second maximum heating % demand that is greater than the first maximum heating % demand and operate the HP system based on the second maximum heating % demand;

wherein the controller sets the first maximum heating % demand as follows:

first maximum heating % demand/% indoor airflow rate=$A+\{B\times((\text{ODT_ref}+C)/(\text{ODT}+D))\hat{}N\}$, wherein:

first maximum heating % demand is an initial maximum limit heating % demand of the HP system, ODT_ref is a reference outdoor temperature in degrees Fahrenheit adjusted for a given HP system, ODT is the outdoor temperature in degrees Fahrenheit, % indoor airflow rate=indoor airflow rate/indoor airflow rate @100% heating demand, where indoor airflow rate is airflow output of an indoor system, and where A, B, C, D, and N are real numbers; and wherein the controller sets the second maximum heating % demand as follows:

second maximum heating % demand/% indoor airflow rate=$A+\{B\times((\text{ODT_ref}+C)/(\text{ODT}+D))^{N}\}$, wherein:

second maximum heating % demand is the maximum heating % demand after recalculation of the first maximum heating % demand of the HP system, ODT_ref is a reference outdoor temperature in degrees Fahrenheit adjusted for a given HP system, ODT is the outdoor temperature in degrees Fahrenheit, % indoor airflow rate=indoor airflow rate/indoor airflow rate @100% heating demand, where indoor airflow rate is airflow output of the indoor system, and where A, B, C, D, and N are real numbers selected such that the second maximum heating % demand value is greater than the first maximum heating % demand.

13. The HP system of claim 12, further comprising:

the indoor system comprising an indoor heat exchanger equipped with an indoor blower;

an outdoor system comprising an outdoor heat exchanger equipped with an outdoor fan, wherein the indoor system and the outdoor system are fluidly coupled by a refrigerant tubing that forms a refrigerant system;

an operating parameter sensor associated with at least one of the indoor system and the outdoor system; and wherein the operating parameter sensor is configured to provide an operating parameter signal of at least one of the indoor system and the outdoor system.

14. The HP system of claim 13, wherein the controller is further configured to increment a heating % demand towards the second maximum heating % demand when a discharge air temperature of the indoor system is equal to or less than a discharge air temperature set point of the indoor system.

15. The HP system of claim 12, wherein the controller is configured to test operating parameters of the HP system at a set time interval and reset operating parameters of the HP system to operational settings based on the first maximum heating % demand.

16. The HP system of claim 12, wherein the controller is configured to reset the HP system to operational settings based on the first maximum heating % demand when an outdoor temperature reaches a predetermined value.

17. The HP system of claim 12, wherein the HP system, when operating based on the second maximum heating % demand, is further configured to receive the refrigerant high pressure trip signal from a refrigerant high pressure trip sensor and recalculate the second maximum heating % demand to a third maximum heating % demand based on a current heating % demand existing when the controller receives the refrigerant high pressure trip signal and operate the HP system based on the third maximum heating % demand.

18. The HP system of claim 17, wherein the controller recalculates the third maximum heating % demand, as follows:

Third maximum heating % demand=$B\times$current heating % demand at trip signal, wherein:

B is a real number having a value between zero and 1.

* * * * *